US009970141B2

(12) United States Patent
Humphrey et al.

(10) Patent No.: US 9,970,141 B2
(45) Date of Patent: May 15, 2018

(54) APPARATUS AND METHOD FOR WASHING AN ELONGATE TEXTILE ARTICLE

(71) Applicant: Morrison Textile Machinery Company, Fort Lawn, SC (US)

(72) Inventors: Herman O. Humphrey, Fort Mill, SC (US); Kent B. Clark, Lancaster, SC (US); Owen G. Khoury, Lancaster, SC (US); Timothy S. Threatt, Lancaster, SC (US); John N. Realmuto, Heath Springs, SC (US)

(73) Assignee: Morrison Textile Machinery Company, Fort Lawn, SC (US)

( * ) Notice: Subject to any disclaimer, the term of this patent is extended or adjusted under 35 U.S.C. 154(b) by 221 days.

(21) Appl. No.: 14/624,903

(22) Filed: Feb. 18, 2015

(65) Prior Publication Data

US 2016/0237607 A1 Aug. 18, 2016

(51) Int. Cl.
*D06B 3/24* (2006.01)
*D06B 23/04* (2006.01)
(Continued)

(52) U.S. Cl.
CPC ..... *D06B 3/24* (2013.01); *D06B 3/12* (2013.01); *D06B 3/18* (2013.01); *D06B 23/021* (2013.01); *D06B 23/04* (2013.01)

(58) Field of Classification Search
CPC ... D06B 3/28; D06B 3/26; D06B 3/10; D06B 3/16; D06B 23/04
(Continued)

(56) References Cited

U.S. PATENT DOCUMENTS 3,060,501 A * 10/1962 Beal ..... C08C 2/06 19/66 R
3,599,447 A * 8/1971 Arashi ..... D06B 3/28 68/177

(Continued)

FOREIGN PATENT DOCUMENTS

CN 202881678 U 4/2013
GB 1179203 1/1970

OTHER PUBLICATIONS

PCT International Search Report and Written Opinion; PCT/US16/17748, dated Apr. 22, 2016.

(Continued)

*Primary Examiner* — David G Cormier
*Assistant Examiner* — Thomas Bucci
(74) *Attorney, Agent, or Firm* — Nelson Mullins Riley & Scarborough LLP

(57) ABSTRACT

Apparatus and method for washing an elongate textile article of extended indeterminate length utilizes a containment structure defining a channel extending upwardly from a lower end to an upper end thereof, with a plurality of undulations spaced-apart from one another within the channel between the lower and upper ends thereof, each undulation extending transversely across the channel. A portion of the lengthwise extent of the traveling textile article is advanced transiently within the channel upwardly from the lower end to the upward end and across the undulations, while a substantially continuous supply of cleansing liquid enters the channel at the upper end to flow downwardly against the upwardly traveling portion of the textile article for cleansing thereof.

11 Claims, 3 Drawing Sheets

(51) Int. Cl.
*D06B 23/02* (2006.01)
*D06B 3/12* (2006.01)
*D06B 3/18* (2006.01)

(58) Field of Classification Search
USPC ... 68/177, 22 R, 178, 5 D, 20, 205, 44, 158, 68/184, 62, 181 R, 9, 175; 8/152, 151, 8/149.1, 149.2, 158, 151.2, 156, 151.1; 134/122 R, 64 R, 15, 131, 199, 9
See application file for complete search history.

(56) References Cited

U.S. PATENT DOCUMENTS 3,647,526 A * 3/1972 Barnes ..... D06B 1/145 118/405
3,729,958 A 5/1973 Christian et al.
3,762,189 A * 10/1973 Marsh ..... D06B 3/28 68/177
3,762,869 A 10/1973 Kennedy et al.
3,766,581 A * 10/1973 Inoue ..... D06B 3/045 68/181 R
3,802,840 A * 4/1974 Chiba ..... D06B 3/28 8/152
3,834,194 A * 9/1974 Stanway ..... D06B 3/26 68/176
3,875,677 A * 4/1975 McWhirter ..... F26B 13/003 28/281
3,924,424 A * 12/1975 Watanabe ..... D06B 3/28 68/177
3,942,695 A * 3/1976 Fleissner ..... D06B 17/06 118/32
3,968,664 A 7/1976 Arioli et al.
3,971,236 A * 7/1976 Bene ..... D06B 3/26 68/176
4,116,023 A 9/1978 Sando et al.
4,150,449 A 4/1979 Talbert
4,155,227 A * 5/1979 Conti ..... D06B 3/105 26/81
4,158,297 A * 6/1979 Winch ..... D06B 3/201 68/158
4,176,532 A 12/1979 Mishima et al.
4,291,555 A * 9/1981 Barriquand ..... D06B 3/28 26/1
4,392,365 A * 7/1983 Miyamoto ..... D06B 23/14 68/177
4,414,756 A * 11/1983 Simpson ..... D06B 17/005 242/366.2
4,440,003 A * 4/1984 Koch ..... D06B 3/26 68/176
4,466,149 A * 8/1984 Schuierer ..... D06B 3/26 68/20
4,479,370 A * 10/1984 Wang ..... D06B 3/20 68/181 R
4,592,107 A * 6/1986 von der Eltz ..... D06B 3/045 68/20
4,607,409 A * 8/1986 Hishimuma ..... D06C 11/00 26/15 R
4,799,278 A * 1/1989 Beeh ..... D06B 23/04 68/175
4,885,814 A * 12/1989 von der Eltz ..... D06B 3/28 68/177
4,922,567 A * 5/1990 Miller ..... D06B 3/16 68/13 R
4,931,064 A * 6/1990 Koch ..... D06B 3/105 8/149.1
4,977,761 A * 12/1990 Hacker ..... D06B 3/28 68/177
5,119,646 A * 6/1992 Jacumin ..... D06B 3/16 226/108
5,170,523 A 12/1992 Scholl
5,201,959 A * 4/1993 Fuller ..... D06B 19/0005 68/15
5,233,717 A 8/1993 Weber et al.
5,361,438 A 11/1994 Parati
5,431,031 A * 7/1995 Vinas ..... D06B 3/16 68/178
5,570,598 A 11/1996 Haven
5,608,955 A * 3/1997 Bozzo ..... D06B 3/10 226/95
5,678,429 A * 10/1997 Zonco ..... B65H 20/10 26/21
5,758,520 A * 6/1998 Hirano ..... D06B 1/08 34/643
5,853,495 A * 12/1998 Gravert ..... C23G 3/021 134/122 R
5,926,970 A * 7/1999 Zonco ..... D06B 3/16 28/165
5,960,650 A * 10/1999 Chi-Lung ..... D06B 23/04 68/177
6,044,509 A * 4/2000 Schrell ..... D06B 3/28 68/177
6,045,680 A * 4/2000 Cawston ..... C23C 18/1644 205/138
6,425,271 B1 * 7/2002 Vinas ..... D06B 3/16 34/636
7,971,302 B2 7/2011 Poy et al.
8,746,018 B2 * 6/2014 Christ ..... D06B 3/28 68/178
2002/0174694 A1 * 11/2002 Bozzo ..... D06B 3/28 68/177
2003/0226381 A1 * 12/2003 Badiali ..... B65H 54/78 68/147
2003/0226382 A1 * 12/2003 Badiali ..... D06B 3/04 68/147
2005/0066694 A1 * 3/2005 Marcora ..... D06B 3/28 68/12.14

OTHER PUBLICATIONS

Benniger AG, "Ben-Wash" Brochure pp. 1-24, created date: Jun. 10, 2009, from website: www.bennigergroup.com/en/textile-finishing/washing/.

* cited by examiner

APPARATUS AND METHOD FOR WASHING AN ELONGATE TEXTILE ARTICLE

BACKGROUND OF THE INVENTION

The present invention relates generally to apparatus and methods for the wet processing of textile articles and, more particularly, to apparatus and methods for washing textile articles, e.g., before or after a dyeing operation.

It has been commonplace for centuries to subject textile articles to various wet processing treatments at varying stages of textile manufacturing operations. As one example, the vast majority of textile articles are dyed at some stage of their overall processing to impart coloration for aesthetic and style reasons. The types of apparatus and processes used for textile dyeing are numerous and diverse. Likewise, the dyes used for such operations are equally varied. Ancillary processes are also commonly carried out on textile articles before and/or after dyeing, e.g., textile articles may be subjected to a washing operation before dyeing to prepare the textile articles to receive dye and, likewise, textile articles may be washed after dyeing to remove excess dye.

Despite many modern advances in textile chemistry and, particularly, in the development of synthetic dyes and dyeing processes, many textile articles continue to be dyed using natural dyes applied by techniques which have been known and used for centuries. One particular example is the use of plant-derived indigo dyes used in the production of cotton-based denim fabrics. Due largely to the increasing popularity of wearing apparel made of denim, particularly so-called blue jeans, the use of indigo dyes continues to rise despite the relatively primitive nature of the dye and inefficiencies and environmental concerns with its use.

Indigo dyeing is predominantly performed on textile yarns, e.g., in the form of a traveling rope assembled of multiple individual yarns or in a traveling open sheet of side-by-side yarns, prior to their incorporation into denim fabric. Basically, the dyeing process requires the yarn rope or sheet to be passed into and out of multiple dip baths to progressively build penetration of the dye into the constituent yarns. Preparatory to dyeing, the yarns may be washed to remove impurities such as natural oils, waxes, and foreign matter which typically are found in natural cotton fibers. Likewise, after the yarn rope or sheet has undergone a sufficient number of dippings to achieve a desired dye shade, the yarns must then be washed through a series of water rinse baths to remove excess dye which remains on the yarn surfaces without having penetrated into the yarns.

Although machinery has been developed to automate these operations, this basic process of indigo dyeing has remained largely unchanged. Overall, the process presents many environmental concerns due to the substantial volumes of water which must be utilized for the numerous dip baths and for pre-dyeing and post-dyeing washings and, in turn, the substantial volumes of dye solution and dirty wash water which must be cleaned. In recent years, considerable effort has been devoted to developing advanced techniques for rehabilitating dye solutions and dirty wash water, but little effort has been successfully devoted to reducing the amount of water used in the first place.

Accordingly, a need exists within the textile industry for improved apparatus and processes used in the wet processing of textile articles, particular in association with textile dyeing operations, by which the amount of clean water devoted to the such wet processing operations can be reduced thereby lessening the required clean-up and attendant environmental impact.

SUMMARY OF THE INVENTION

It is accordingly an object of the present invention to improve the apparatus and methods used for the washing of textile articles to lessen the amount of clean water or other cleansing liquid required. A more specific object of the present invention is to provide an improved apparatus and method for rinsing indigo-dyed yarn ropes or sheets using a substantially reduced volume of water as compared to known conventional rinsing operations. A further object of the present invention is that such improvements may find a broader applicability in other textile wet processing operations. Still further objects and benefits of the present invention will be apparent from the following disclosure of a preferred embodiment of the invention.

Briefly summarized, the present invention provides an apparatus for washing an elongate textile article of extended indeterminate length, and basically comprises a containment structure defining a channel extending upwardly from a lower end to an upper end thereof, with a plurality of undulations spaced-apart from one another within the channel between the lower and upper ends thereof, each undulation extending transversely across the channel. An arrangement is provided for guiding the elongate textile article to travel in its longitudinal extent with a portion of its lengthwise extent advancing transiently within the channel upwardly from the lower end to the upward end and across the undulations. A substantially continuous supply of a cleansing liquid, e.g., water, is delivered into the channel at the upper end for downward flow against the upwardly traveling portion of the textile article for cleansing thereof.

As noted, the apparatus is particularly adapted for rinsing indigo dyestuff from an elongate textile rope or sheet comprised of multiple textile yarns and containing an indigo dye partially penetrated into the yarns and partially residing on surfaces of the yarns from which rinsing of the indigo dye is required. However, the present invention is not intended to be so limited in its potential uses and application, but is believed to be equally applicable to other textile rinsing and/or washing operations for other types of textile articles.

In a preferred embodiment of the present apparatus, the channel may have a lateral dimension sufficient for a plurality of the elongate textile articles to travel alongside one another within the channel. According to another aspect of the invention, the containment structure preferably defines an open front to the channel for viewing of the rinsing action on the traveling textile article. The channel preferably extends at an inclined upward angle. More preferably, the containment structure may have an upwardly inclined bottom wall bordered by two lateral side walls which define the channel therebetween. The undulations may comprise transverse corrugations spaced along the bottom wall of the containment structure.

In a preferred embodiment, the arrangement for guiding the elongate textile article may comprise guide rollers adjacent the lower and upper ends of the channel and, more particularly, the guide rollers may comprise a pair of nip rollers disposed adjacent the upper end of the channel for squeezing excess rinse water or other cleansing liquid from the textile article after exiting the channel. Advantageously, the nip rollers may be disposed to redirect the squeezed rinse water or cleansing liquid into the channel.

Preferably, the supply of water or other cleansing liquid is adapted to flow gravitationally into and through the channel. For example, the supply of water or other cleansing liquid may comprise a weir disposed to overflow into the upper end of the channel. It is further preferred that a vessel is disposed adjacent the lower end of the channel for collecting rinse water or other cleansing liquid flowing from the lower end of the channel.

In a particularly advantageous installation of the present apparatus, a plurality of the apparatus may be arranged adjacent one another for travel of the textile article in sequence through the respective channels thereof. In such an installation, each apparatus may comprise a vessel disposed adjacent the lower end of its respective channel for collecting rinse water or other cleansing liquid and conduits may be provided to connect the vessels in sequence to provide for counterflow of the collected water or other cleansing liquid to the preceding apparatus.

According to another aspect of the present invention, a method is provided for washing an elongate textile article of extended indeterminate length. Briefly summarized, the method comprises the basic steps of guiding the elongate textile article to travel in its longitudinal extent with a portion of the lengthwise extent of the textile article advancing transiently within a channel along an upwardly inclined path and across a plurality of spaced-apart transverse undulations within the channel, while a substantially continuous supply of water or other cleansing liquid is delivered into an upper end of the channel for downward flow against the upwardly traveling portion of the textile article for cleansing thereof.

In a preferred embodiment of the method, excess rinse water or other cleansing liquid is squeezed from the textile article after exiting the channel. It is further preferred that the rinse water or other cleansing liquid be flowed gravitationally into and through the channel. The rinse water or other cleansing liquid is preferably collected at a lower end of the channel. In an advantageous installation, the guiding and delivering steps are repeated multiple times in sequence until the textile article achieves a desired cleanliness.

BRIEF DESCRIPTION OF THE DRAWINGS

The accompanying drawings and the following description thereof are provided for illustrative purposes in describing one possible embodiment of the present invention, but without limitation on the overall scope, substance and broader applicability of the invention in other embodiments.

DETAILED DESCRIPTION OF THE PREFERRED EMBODIMENTS

Figure 1:
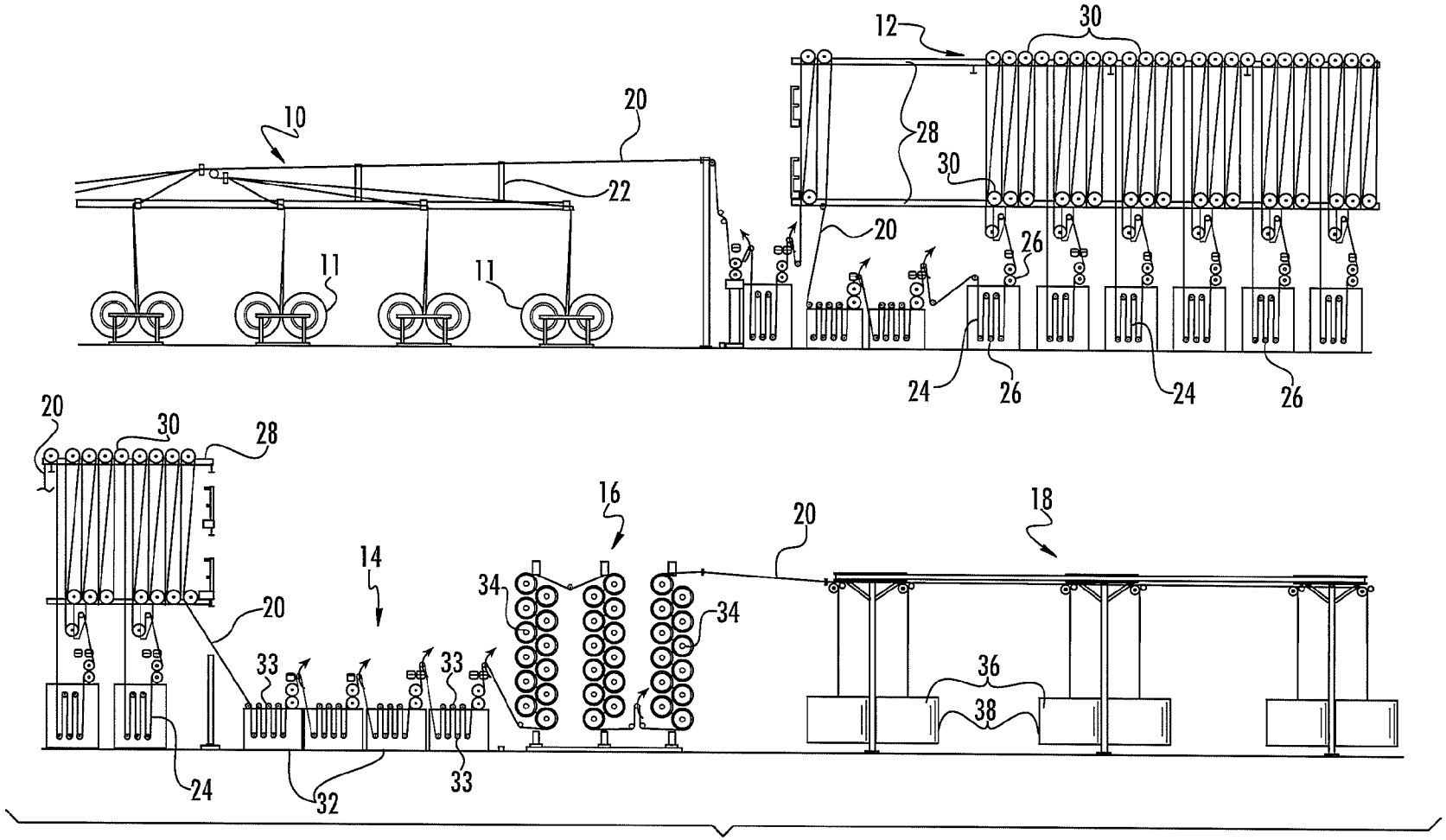
FIG. 1 Prior Art
FIG. 1 is a schematic diagram depicting a conventional prior art form of dye range for the indigo dyeing and rinsing of textile yarn ropes.

Referring now to the accompanying drawings and initially to FIG. 1, a typical conventional form of textile dye range used for the indigo dyeing of textile yarn ropes is schematically depicted and basically comprises a creel section indicated generally at 10, a dyeing section indicated generally at 12, a washing/rinsing section indicated generally at 14, a drying section indicated generally at 16, and a coiling section indicated generally at 18. The creel section 10 comprises a plurality of storage beams 11 from which a corresponding plurality of textile yarn ropes 20 are delivered via an overhead guide structure 22 to an entrance end of the dyeing section 12. The dyeing section 12 comprises a series of vats 24, each containing an indigo dye solution, with guide rollers 26 disposed above and within each vat 24 for directing the ropes 20 to travel into and out of the dye solution. A superstructure 26, sometimes referred to in the industry as a "skying" section, is situated above the series of vats 24 and comprises a series of multiple guide rollers 30 by which the yarn ropes 20 are elevated out of each bath to allow for oxidation and penetration of the dye into the yarn ropes before immersion in the next following vat 24. The number of vats 24 may vary depending on the depth of shade to be imparted to the yarn ropes 20.

Following the dyeing section 12, the yarn ropes are directed from the superstructure 28 into a series of rinse baths 32 in the washing/rinsing section 14, each bath 32 being filled with a quantity of water within which the ropes 20 are guided via rollers 33 in a serpentine path to progressively rinse excess indigo dye from the ropes 20. The number of rinse baths 32 may vary in relation to the number of dye vats 24 and, in turn, according to the amount of retained excess indigo dye required to be removed from the ropes 20. Following the last rinse bath 32, the ropes are directed to the drying section 16 wherein the ropes follow a serpentine path about a series of drying drums 34 and are then directed to the coiling station 18 at which each rope 20 is respectively directed to a coiler mechanism 36 which lays the rope 20 into a storage container 38 in a series of overlapping coils until the container is filled.

As previously indicated, one of the inefficiencies and environmental disadvantages of conventional indigo dye ranges of the type of FIG. 1 is the significant volume of water required in the washing/rinsing section 14 to sufficiently remove the excess indigo dye before the ropes 20 can be dried and coiled into the storage containers 38 for further processing. The present invention provides an alternative form of washing/rinsing section 114, depicted in FIG. 2, which can be substituted for the washing/rinsing section 14 in conventional dyeing ranges and which will perform an equally effective rinsing of excess dye using a substantially reduced volume of water.

Figure 2:
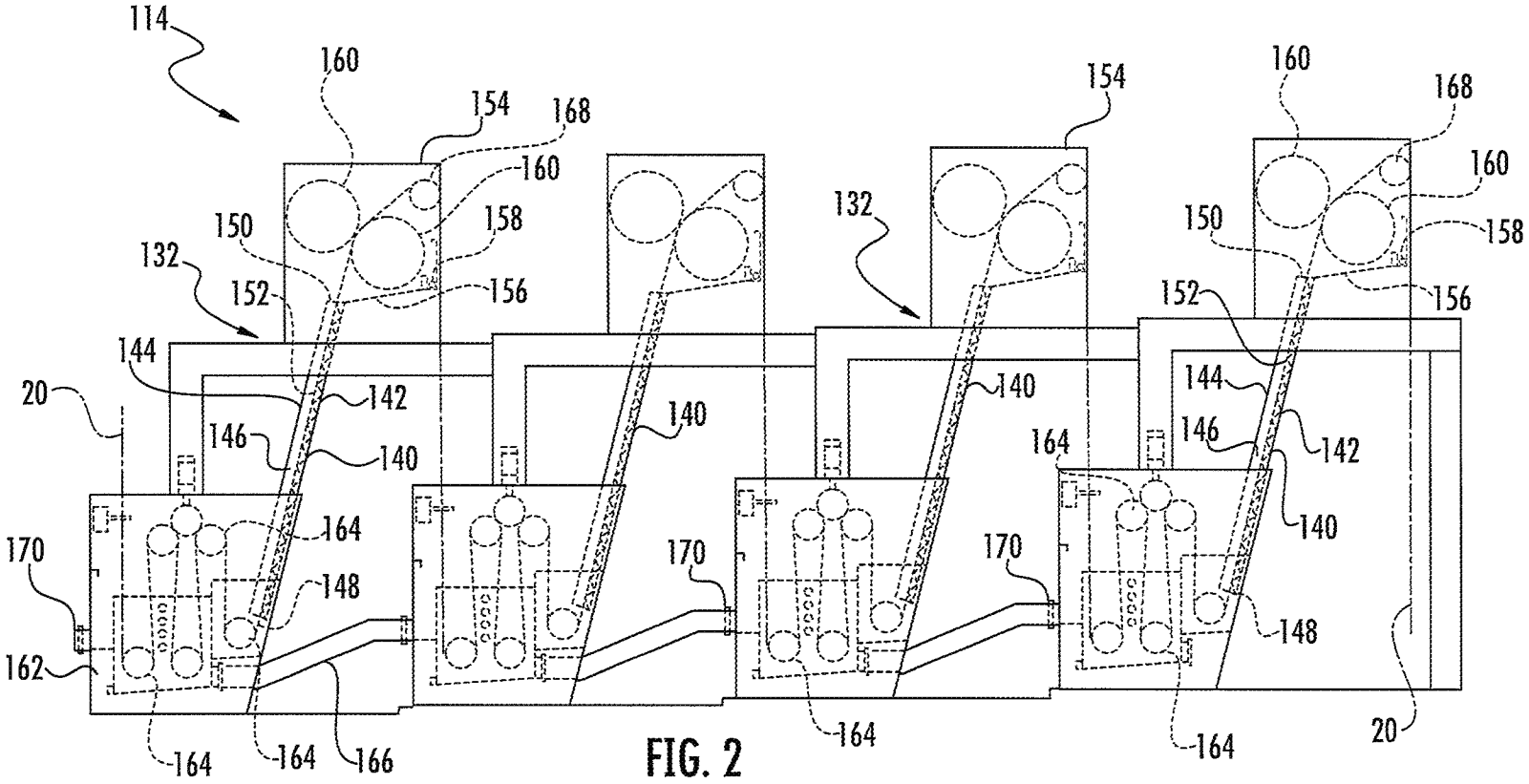
FIG. 2 is a schematic diagram depicting an apparatus in accordance with a preferred embodiment of the present invention for rinsing indigo dye from textile yarn ropes.

With reference now to FIG. 2, the washing/rinsing section 114 of the present invention comprises a series of rinsing apparatus 132 which do not rely upon or utilize a contained bath of rinse water. Each rinse apparatus 132 basically comprises an elongated angularly-upstanding rinsing containment structure 140 having a bottom wall 142 flanked by spaced-apart lateral side walls 144 collectively defining therewithin a channel 146 extending upwardly at an incline from a lower end 148 to an upper end 150. Within the channel 146, the bottom wall 142 is formed with a plurality of undulations 152, preferably in the form of a series of angular corrugations projecting forwardly from the bottom wall 142 at spacings along the length of the channel 146, each undulation 152 extending transversely across the channel 146 between the opposing side walls 144.

Each rinsing apparatus 132 further includes a superstructure 154 situated directly above the containment structure 140. The superstructure 154 supports a weir 156 disposed adjacent and directly above the upper end of the channel 146 and continuously fed with a flow of water from a water feed 158 to overflow into and flow gravitationally downwardly through the channel 146. The superstructure 154 also supports a pair of nip rollers 160 spaced slightly above the weir 156 with the nip location between the rollers disposed directly above the upper end 150 of the channel 146. The lower end of the containment structure 140 extends into a collection vessel 162 which includes a series of guide rollers 164. The collection vessels 162 of the respective rinsing apparatus 132 are connected for water flow between each other by a series of conduits 166.

The operation of the washing/rinsing section 114 of the present invention may thus be understood. As previously indicated, the washing/rinsing section 114 would be situated in place of the washing/rinsing section 14 in an otherwise conventional indigo dye range such as that shown in FIG. 1. Thus, the washing/rinsing section 114 will receive one or more textile yarn ropes 20, typically a plurality of such ropes, each of an elongate extended indeterminate length, traveling lengthwise in side-by-side slightly spaced-apart relationship as delivered from the dyeing section 12. The incoming ropes 20 are directed into the first rinsing apparatus 132 and trained in serpentine fashion about the guide rollers 164 within its collection vessel 162. From the last guide roller 164, the ropes 20 are directed into the lower end 148 of the channel 146 and then upwardly through the full length of the channel 146 of the containment structure 140 to travel across and in contact with or at least close proximity to the series of undulations 152, with the ropes 20 exiting the upper end 150 of the channel 146 and proceeding immediately into the nip between the nip rollers 160.

As the ropes 20 progress in this path of travel, water from the weir 156 continuously counter flows gravitationally downwardly through the channel 146 against the upwardly moving ropes 20 to rinse the portion of the length of each rope 20 transiently advancing upwardly through the channel 146. As the wetted ropes 20 pass between the nip rollers 160, the ropes 20 are squeezed by the rollers 160, causing the water squeezed from the ropes 20 to fall gravitationally into the upper end of the channel 146. The collection vessel 162 collects the downward flow of water exiting the lower end 148 of the channel 146 and exhausts the collected water via an exhaust opening 170. Following the nip rollers 160, the ropes pass about another guide roller 168 and are directed downwardly therefrom into the collection vessel 162 and about the guide rollers 164 thereof within the next following rinsing apparatus 132 to undergo the same process.

Figure 3:
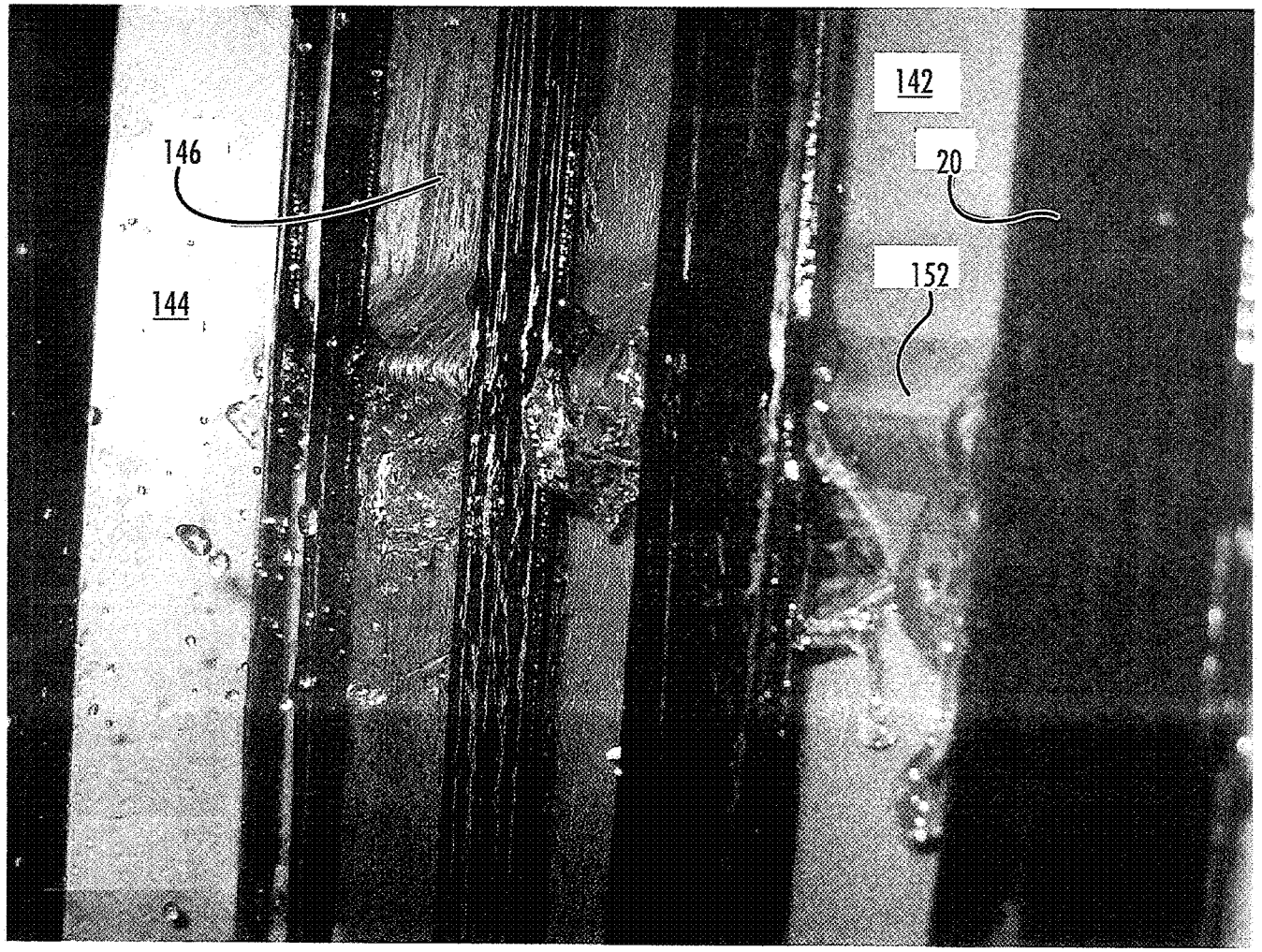
FIG. 3 is a photograph depicting a close-up image of the rinsing action achieved in the apparatus of FIG. 2.

The undulations 152 in the containment structure 140 contribute to the effectiveness of the rinsing apparatus 132 by periodically interrupting the gravitational flow of the rinse water and causing the rinse water to be diverted outwardly to penetrate into and through each rope 20. FIG. 3 is a photograph taken of an actual demonstration prototype of the rinsing apparatus 132 during a non-production operation conducted for demonstrative developmental purposes and depicts the action of the gravitationally flowing rinse water at the location of one undulation 152. This water action induced by the undulations 152 promotes more rapid rinsing of surface dye from the constituent yarns in the ropes 20 than can be achieved by merely passing the ropes 20 through a non-moving bath of water as in conventional dye ranges.

As will be readily recognized and understood by persons skilled in the industry, the volume of water required by each rinsing apparatus 132 to perform the ongoing rinsing operation will be substantially reduced in comparison to the volume of water required to be maintained within the rinse baths 32 in a conventional indigo dye range. Although empirical testing of the present apparatus and method in actual operation has not yet been performed, it is presently anticipated that the amount of required water may be reduced by about 30%, but actual results in a given embodiment of the invention could be greater or lesser. An additional feature of the present invention is that the rinse water collected in the collection vessel 162 of each rinsing apparatus 132 is exhausted via its exhaust opening 170 into the collection vessel 162 of the immediately preceding rinsing apparatus 132 from which the water may in part be directed to the weir 156 of such rinsing apparatus 132, which further contributes to the overall water savings. The number of rinsing apparatus 132 required to make up a washing/rinsing section 114 in any given indigo dye range will depend upon various factors, including but not limited to the number of dyeing vats 24 making up the dyeing section 12, but it is anticipated that the number of rinsing apparatus 132 would be no greater than and potentially less than the number of rinse baths 32 conventionally required.

An additional advantage of the present washing/rinsing section 114 is that the channel 146 is open at the forwardly facing side of each containment structure 140, which enables operational personnel to visually inspect the clarity of or, alternatively, the dye coloration in the rinse water flowing through each channel 146 in each rinsing apparatus 132 so as to monitor the effectiveness of the rinsing operation. In turn, adjustments may be made in operational parameters, such as water flow rate, etc., as necessary to achieve the desired degree of rinsing of the ropes using the least amount of water required.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for washing an elongate textile article of extended indeterminate length, the apparatus comprising:

a containment structure having a bottom wall oriented at an upwardly extending angle with spaced-apart lateral side walls extending outwardly from the bottom wall, the bottom and side walls collectively defining therewithin a channel extending angularly upwardly from a lower end to an upper end thereof, the channel being open and unconfined between outward extents of the side walls, a plurality of corrugations along the bottom wall within the channel in spaced-apart relation to one another from the lower end of the channel to the upper end of the channel, each corrugation extending transversely across the bottom wall between the side walls, guide elements for directing the elongate textile article to travel in its longitudinal extent within the channel upwardly from the lower end to the upper end and transversely across the corrugations, and means for delivering an unpressurized flow of a cleansing liquid into the upper end of the channel onto the bottom wall to flow gravitationally downwardly across the corrugations oppositely to the upwardly traveling textile article for substantially the entire length of the channel, each corrugation having angular surfaces projecting in converging relation away from the bottom wall, the angular surfaces being configured to deflect the cleansing liquid as it flows downwardly through the channel to penetrate the textile article for cleansing thereof.

2. An apparatus for washing an elongate textile article according to claim 1, wherein the channel has a lateral dimension between the side walls sufficient for a plurality of the elongate textile articles to travel alongside one another within the channel.

3. An apparatus for washing an elongate textile article according to claim 1, wherein the guide elements comprises guide rollers adjacent the lower and upper ends of the channel.

4. An apparatus for washing an elongate textile article according to claim 1, wherein the guide elements comprise a pair of nip rollers defining a nip area therebetween disposed directly above the upper end of the channel for squeezing excess cleansing liquid from the textile article after exiting the channel to fall gravitationally back into the upper end of the channel.

5. An apparatus for washing an elongate textile article according to claim 1, wherein the means for delivering an unpressurized flow of a cleansing liquid comprises a weir disposed to overflow into the upper end of the channel.

6. An apparatus for washing an elongate textile article according to claim 1, further comprising a vessel disposed adjacent the lower end of the channel for collecting cleansing liquid flowing from the lower end of the channel.

7. An apparatus for washing an elongate textile article according to claim 1, further comprising a plurality of the apparatus arranged adjacent one another for travel of the textile article in sequence through the respective channels thereof.

8. An apparatus for washing an elongate textile article according to claim 7, wherein each of the plurality of apparatus comprises a vessel disposed adjacent the lower end of its respective channel for collecting cleansing liquid and conduits connecting the vessels in sequence to counterflow of collected cleansing liquid to the preceding apparatus.

9. An apparatus for washing an elongate textile article according to claim 1, wherein the textile article is a rope comprised of multiple textile yarns.

10. An apparatus for washing an elongate textile article according to claim 9, wherein the rope contains an indigo dye partially penetrated into the yarns and partially residing on surfaces of the yarns from which rinsing of the indigo dye is required.

11. A textile dye range comprising in combination:

(a) a plurality of textile yarns collected in the form of an elongate rope of indeterminate length, the yarns of the rope having an affinity for indigo dye, (b) an apparatus for receiving the yarns of the rope for indigo dyeing thereof, (c) means for supplying indigo dye to the apparatus for indigo dyeing, and (d) an apparatus arranged for receiving the yarns of the rope from the apparatus for indigo dyeing for washing excess indigo dye from the yarns of the rope, wherein the washing apparatus comprises:

(i) a containment structure having a bottom wall oriented at an upwardly extending angle with spaced-apart lateral side walls extending outwardly from the bottom wall, the bottom and side walls collectively defining therewithin a channel extending upwardly from a lower end to an upper end thereof, the channel being unconfined between outward extents of the side walls, (ii) a plurality of corrugations along the bottom wall within the channel, each corrugation extending transversely across the bottom wall between the side walls in spaced-apart relation to one another between the lower and upper ends of the channel, (iii) guide elements for directing the elongate textile rope to travel in its longitudinal extent within the channel upwardly from the lower end to the upward end and transversely across the corrugations, and (iv) means for delivering an unpressurized flow of cleansing liquid into the upper end of the channel onto the bottom wall to flow gravitationally downwardly across the corrugations oppositely to the upwardly traveling textile rope for cleansing thereof for substantially the entire length of the channel, (v) each corrugation having angular surfaces projecting in converging relation away from the bottom wall, the angular surfaces being configured to deflect the cleansing liquid as it flows downwardly through the channel to penetrate and separate the constituent yarns of the rope.

* * * * *